US009819069B2

(12) United States Patent
Piskun

(10) Patent No.: US 9,819,069 B2
(45) Date of Patent: Nov. 14, 2017

(54) MULTI-BAND ANTENNA WITH A BATTERY RESONATOR

(71) Applicant: Google Inc., Mountain View, CA (US)

(72) Inventor: Vadim Piskun, San Jose, CA (US)

(73) Assignee: Google Inc., Mountain View, CA (US)

( * ) Notice: Subject to any disclaimer, the term of this patent is extended or adjusted under 35 U.S.C. 154(b) by 336 days.

(21) Appl. No.: 14/619,584

(22) Filed: Feb. 11, 2015

(65) Prior Publication Data

US 2016/0233582 A1 Aug. 11, 2016

(51) Int. Cl.

| | |
|---|---|
| ***H01Q 1/00*** | (2006.01) |
| ***H01Q 1/22*** | (2006.01) |
| ***H01Q 1/44*** | (2006.01) |
| ***H01Q 9/42*** | (2006.01) |
| ***H01Q 5/371*** | (2015.01) |
| ***H01Q 5/378*** | (2015.01) |
| *H01Q 1/48* | (2006.01) |

(52) U.S. Cl.

CPC ..... *H01Q 1/22* (2013.01); *H01Q 1/44* (2013.01); *H01Q 5/371* (2015.01); *H01Q 5/378* (2015.01); *H01Q 9/42* (2013.01); *H01Q 1/48* (2013.01)

(58) Field of Classification Search

CPC H01Q 1/22; H01Q 1/44; H01Q 5/378; H01Q 9/42; H01Q 5/371; H01Q 1/48

USPC ..... 343/720, 866, 702, 873

See application file for complete search history.

(56) References Cited

U.S. PATENT DOCUMENTS

| | | | | |
|---|---|---|---|---|
| 5,020,136 | A | 5/1991 | Patsiokas et al. | |
| 5,227,805 | A | 7/1993 | King et al. | |
| 6,492,058 | B1 * | 12/2002 | Watanabe | H01M 2/1061 429/121 |
| 7,736,800 | B2 * | 6/2010 | Lee | H01M 2/04 429/180 |

(Continued)

FOREIGN PATENT DOCUMENTS

EP 1923951 A1 5/2008

OTHER PUBLICATIONS

PCT/US2016/017353, International Search Report and Written Opinion issued in PCT/US2016/017353 dated May 18, 2016, dated May 18, 2016, p. 14.

(Continued)

*Primary Examiner* — Jean B Jeanglaude
(74) *Attorney, Agent, or Firm* — Morris & Kamlay LLP

(57) ABSTRACT

Systems and techniques are provided for multi-band antenna with a battery resonator. An antenna may include a ground plane, a front ground plane extension and a rear ground plane extension attached to the ground plane, a dielectric layer, an antenna layer, and a battery. The dielectric layer may include dielectric material placed over the front ground plane extension. The dielectric layer may be in between the antenna layer and the front ground plane extension. The antenna layer may include a high frequency antenna element and a low frequency antenna element attached to a transmission line. The battery may be placed in between and proximity coupled to the front ground plane extension and the rear ground plane extension. The front ground plane extension, rear ground plane extension, ground plane and battery may be proximity coupled to the low-frequency antenna element.

21 Claims, 14 Drawing Sheets

(56) References Cited

U.S. PATENT DOCUMENTS

| | | | | |
|---|---|---|---|---|
| 7,859,480 | B2 * | 12/2010 | Shimizu | H01Q 1/22 343/702 |
| 8,736,495 | B2 | 5/2014 | Cho | |
| 8,761,843 | B2 | 6/2014 | Ikehata et al. | |
| 2009/0109099 | A1 | 4/2009 | Jang et al. | |
| 2009/0315789 | A1 | 12/2009 | Sung et al. | |
| 2010/0164835 | A1 | 7/2010 | Tai et al. | |
| 2011/0109509 | A1 | 5/2011 | Chou et al. | |
| 2014/0071004 | A1 | 3/2014 | Jenwatanavet et al. | |
| 2014/0091974 | A1 | 4/2014 | Desclos et al. | |

OTHER PUBLICATIONS

IPRP dated Aug. 15, 2017 as received in Application No. PCT/US2016/017353.

* cited by examiner

MULTI-BAND ANTENNA WITH A BATTERY RESONATOR

BACKGROUND

A multi-band antenna may include antenna elements that can operate on separate frequency bands. This may allow for a single antenna to be used in an electronic device that may need to be able to send and receive signals on distinct frequency bands. Devices which make use of multi-band antennas may be battery-powered. The devices may be very small, resulting in the battery being located very close to the multi-band antenna and other metal components. The presence of the battery may impair the performance of the multi-band antenna, diminishing the radiative properties of the antenna.

BRIEF SUMMARY

According to an embodiment of the disclosed subject matter, an antenna may include a ground plane, a front ground plane extension attached to the ground plane, a rear ground plane extension attached to the ground plane, a dielectric layer including a dielectric material placed over the front ground plane extension, an antenna layer placed over the dielectric layer such that the dielectric layer is in between the antenna layer and the front ground plane extension, the antenna layer including a high frequency antenna element, a low frequency antenna element, and a transmission line, the high frequency antenna element having an end attached to the transmission line and the low-frequency antenna element having an end attached to the transmission line, and a battery placed in between the front ground plane extension and the rear ground plane extension such that the battery may be proximity coupled to the front ground plane extension and the rear ground plane extension. The front ground plane extension, rear ground plane extension, ground plane and battery may be proximity coupled to the low-frequency antenna element.

The front ground plane extension and the rear ground plane extension may be placed perpendicular to the ground plane. The front ground plane extension may include a cutout. The transmission line may be connected to a power source through the cutout. The power source may be the battery. The antenna layer may include copper. The ground plane may be circular. The front ground plane extension and the rear ground plane extension may be placed diametrically opposite each other across the ground plane.

The battery may be placed between and in contact with battery terminals. The battery terminals may have no RF ground. The battery may be placed within a metalized compartment. A battery resonator may include the ground plane, the front ground plane extension, the rear ground plane extension, and the battery.11. The apparatus of claim 1, wherein the battery resonator is a radiator for low-frequency operation of the antenna apparatus.

The low-frequency antenna element may be placed relative to the battery resonator such that the low-frequency antenna element and the battery resonator resonate on continuous low-frequency band. The ground plane may be a printed circuit board.

According to an embodiment of the disclosed subject matter, a means for obtaining a low-frequency antenna element, a means for obtaining a high-frequency antenna element, a means for attaching the low-frequency antenna element and the high-frequency antenna element to a dielectric layer, a means for attaching the dielectric layer to a front ground plane extension, and a means for placing a battery between the front ground plane extension and the rear ground plane extension, are included.

Systems and techniques disclosed herein may allow for a multi-band antenna with a battery resonator. Additional features, advantages, and embodiments of the disclosed subject matter may be set forth or apparent from consideration of the following detailed description, drawings, and claims. Moreover, it is to be understood that both the foregoing summary and the following detailed description are examples and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
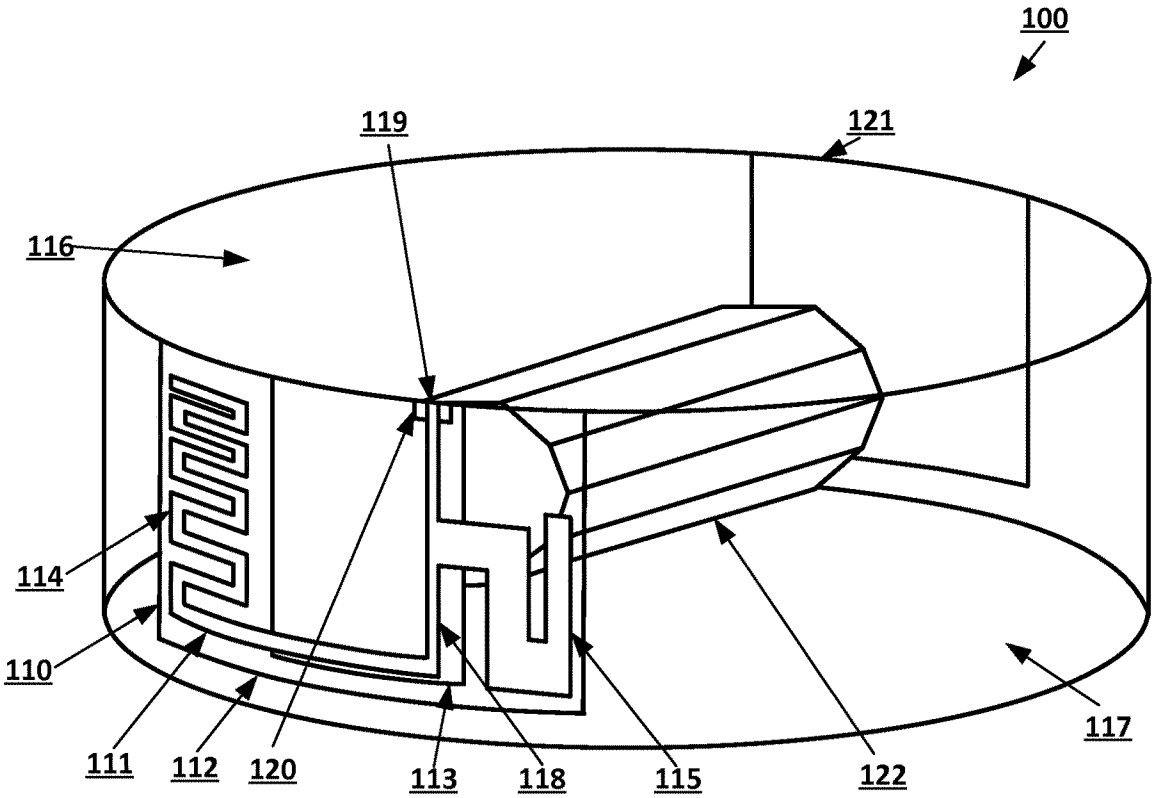
FIG. 1 shows an example perspective view of a multi-band antenna with a battery resonator according to an implementation of the disclosed subject matter.

According to embodiments disclosed herein, a multi-band antenna with a battery resonator may include antenna elements for separate frequency bands and may use a battery to assist with the resonance of the antenna elements. A multi-band antenna may include a low-frequency antenna element and a high frequency antenna element connected to the same transmission line, forming an antenna layer. The antenna layer may be attached to a dielectric material, which may extend underneath the low-frequency and high-frequency antenna elements. The dielectric material may be attached to a front ground plane extension, which may be an extension of a ground plane for the multi-band antenna. The ground plane may include a rear ground plane extension, which may be positioned opposite the front ground plane extension. A battery may be placed in between, but not in contact with, the front and rear ground plane extensions. The battery may be proximity coupled to the front and rear ground plane extensions and ground plane, forming a battery resonator. The battery resonator may be proximity coupled to the low-frequency antenna element, and the battery resonator and the low-frequency antenna element may act as a single low-frequency resonator for the multi-band antenna.

The antenna layer of the multi-band antenna with a battery resonator may include the low-frequency antenna element and high-frequency antenna element connected to a transmission line. The low-frequency antenna element may be made of any suitable material in any suitable shape for resonating at lower frequencies. For example, the low-frequency antenna element may be made from PCB flex material, and may be a meander antenna with a number of turns suitable for low-frequency usage. The high-frequency antenna element may be made of any suitable material in any suitable shape for resonating at higher frequencies. For example, the high-frequency antenna element may be made from PCB flex material, and may be a meander antenna with a number of turns suitable for high-frequency usage, or may be shaped as a straight arm. The low-frequency antenna element and high-frequency antenna element may be connected to the transmission line at any suitable location and in any suitable manner. For example, the low-frequency antenna element, high-frequency antenna element, and transmission line may be formed from the same piece of material, which may be, for example, PCB flex material. The low-frequency antenna element may be connected to the lower end of the length of the transmission line, while the high-frequency antenna element may be connected towards the middle of the length of the transmission line. The top of the transmission line may be a feed point for the transmission line, which may in turn feed the low-frequency antenna element and the high-frequency antenna element.

A dielectric layer of the multi-band antenna with a battery resonator may be made of any suitable dielectric material. The dielectric layer may extend underneath the surface area of the low-frequency antenna element, high-frequency antenna element, and the transmission line. The dielectric layer may prevent the low-frequency antenna element, high-frequency antenna element, and the transmission line from being in direct contact with the front ground plane extension and other components of a device on which the multi-band antenna with a battery resonator is installed.

The ground plane may be made of any suitable material, such as, for example, copper, and may act as a radiator for multi-band antenna with a battery resonator. The ground plane may be, for example, a printed circuit board (PCB) of an electronic device, such as a sensor. The ground plane may be any suitable shape and size. For example, the ground plane may be circular with a diameter of 80 mm.

The front ground plane extension may be an extension of the ground plane for the multi-band antenna with a battery resonator. The front ground plane extension may be made of the same material as the ground plane, and may be formed from the same piece of material as the ground plane or from a separate piece of material. The front ground plane extension may be connected to the ground plane beneath antenna layer and the dielectric layer. The dielectric layer may be attached to or otherwise cover the front ground plane extension, physically separating the antenna layer from the front ground plane extension. The front ground plane extension may be attached at any suitable angle to the ground plane, including, for example, perpendicular to the surface of the ground plane. A small section of the front ground plane extension may include a cutout to allow the transmission line from the antenna layer to pass through the front ground plane extension and connect to an amplifier and power source at the feed point.

The rear ground plane extension may be an extension of the ground plane for the multi-band antenna with a battery resonator, may be made of the same material as the ground plane, and may be formed from the same piece of material as the ground plane or from a separate piece of material. The rear ground plane extension may be connected to the ground plane on the opposite side from the front ground plane extension. For example, on a circular ground plane the front ground plane extension and rear ground plane extension may be connected diametrically opposite each other. The rear ground plane extension may be attached at any suitable angle to the ground plane, including, for example, perpendicular to the surface of the ground plane. The front ground plane extension and rear ground plane extension may be any suitable size relative to each other. For example, the rear ground plane extension may be slightly larger than the front ground plane extension.

A battery may be placed in between the front and rear ground plane extensions. The battery may be any suitable for battery for powering the multi-band antenna with a battery resonator and other components of the device. The battery may not come into physical contact with either the front or rear ground plane extension. The battery may be proximity coupled to the front and rear ground plane extensions and the ground plane, forming a battery resonator. The battery, ground plane, and front and rear ground plane extensions may be proximity coupled to the low-frequency antenna element, allowing the battery resonator and low-frequency antenna element to act as a low-frequency resonator for the multi-band antenna. The proximity coupling of the battery resonator to the low-frequency antenna element may allow a current in the low-frequency antenna element to excite the battery resonator.

The shape and position of the low-frequency antenna element may be adjusted based on the size of the battery and the battery's proximity to the element. The low-frequency antenna may be shaped and positioned to resonate operate in a frequency band that is the same as or that is overlapping or contiguous with the frequency band at which the battery resonator resonates. The frequencies at which the battery resonator resonates may be based on, for example, the size, shape and choice of the battery material, the size, shape and material of the ground plane and front and rear ground plane extensions, and the positioning of the ground plane, front and rear ground plane extensions, battery, and other components of the device in which the multi-band antenna with a battery resonator is installed. The battery terminals may be selected and arranged so that they do not have a good Radio Frequency (RF) ground. The battery compartment in which the battery is installed may be metallic, which may ensure that the proximity coupling between the battery resonator and the low-frequency antenna element does not change.

The multi-band antenna with a battery resonator may be fed by any suitable amplifier, running off any suitable power source, from a trace connected to the transmission line. The power source may be, for example, the battery of the battery resonator.

The low-frequency antenna element and battery resonator may be excited by low frequencies and the high-frequency antenna element may be excited by high frequencies, thus allowing for operation within two distinct frequency ranges. For example, the low-frequency antenna element and the battery resonator may operate at frequencies around 800 to 960 MHz, while the high-frequency resonator may operate at around 1700 to 2200 MHz. The battery resonator may act as a radiator for the lower frequencies, as current in the transmission line may induce voltage in the structure of the battery as well as in the ground plane and front and rear ground plane extensions. The multi-band antenna with a battery resonator may be used for electronic communications, including transmitting and receiving on any two separate frequency bands.

The multi-band antenna with a battery resonator may be attached to any suitable electronic device. For example, the multi-band antenna with a battery resonator may be attached to the plastic body of a battery powered electronic device that may be for use in, for example, a smart home environment. The electronic device may be, for example, a sensor.

In some implementations, the antenna layer may not include the high-frequency antenna element. The low-frequency antenna element may act with the battery resonator as a low-frequency resonator, and the antenna may be a single-band antenna with a battery resonator.

FIG. 1 shows an example perspective view of a multi-band antenna with a battery resonator according to an implementation of the disclosed subject matter. A device 100, which may any suitable electronic device, may include a multi-band antenna with a battery resonator 110. The device 100 may be, for example, any suitable computing device, such as laptop, smartphone, tablet, or other computing device, or any component thereof, or any suitable electronic device, such as, for example, an electronic device used in home automation or a sensor for a smart home environment, such as described with respect to FIG. 10. The multi-band antenna with a battery resonator 110 may include an antenna layer 111, a dielectric layer 112, and a front ground plane extension 113 arranged on a plastic wall 117 of the device 100. The multi-band antenna with a battery resonator 110 may also include a rear ground plane extension 121 and a battery 122, which may form a battery resonator along with the front ground plane extension 113 and a ground plane 116.

The antenna layer 111 may include a low-frequency antenna element 114, a high-frequency antenna element 115, and a transmission line 118. The low-frequency antenna element 114 may be made of any suitable material in any suitable shape for resonating on lower frequencies. For example, the low-frequency antenna element 114 may be made from PCB flex material, and may be a meander antenna with a number of turns suitable for low-frequency usage. The high-frequency antenna element 115 may be made of any suitable material in any suitable shape for resonating on higher frequencies. For example, the high-frequency antenna element 115 may be made from PCB flex material, and may be a meander antenna with a number of turns suitable for high-frequency usage.

The transmission line 118 may be any suitable transmission line for transmitting electricity to and from the low-frequency antenna element 114 and the high-frequency antenna element 115. For example, the transmission line 116 may be made from PCB flex material. The transmission line 118 may feed power to the multi-band antenna with a battery resonator 110, and may return signals received by the multi-band antenna with a battery resonator 110 to the device 100. The low-frequency antenna element 114 may be connected to the lower end of the length of the transmission line 118, while the high-frequency antenna element 115 may be connected towards the middle of the length of the transmission line 116. The top of the transmission line 118 may be a feed point 119 for the low-frequency antenna element 114 and the high-frequency antenna element 115. The low-frequency antenna element 114 and high-frequency antenna element 115 may be connected to the transmission line 118 at any suitable location and in any suitable manner. The low-frequency antenna element 114, the high-frequency antenna element 115, and the transmission line 118 of the antenna layer 111 may be formed from the same piece of material, which may be, for example, PCB flex material.

The dielectric layer 112 may be below the antenna layer 111, which may be attached to the dielectric layer 112 in any suitable manner. The dielectric layer 112 may be made from any suitable dielectric material, and may extend underneath the surface area of the antenna layer 111.

The ground plane 116 may be made of any suitable material, such as, for example, copper, and may act as a radiator at lower frequencies along with the front ground plane extension 113, the rear ground plane extension 121, and the battery 122, as a battery resonator. The ground plane 116 may be any suitable size and shape, and may, for example, be a circle with a diameter between 60 mm and 100 mm. For example, the ground plane 116 may have a diameter of 80 mm.

The ground plane 116 may include the front ground plane extension 113. The front ground plane extension 113 may be made of the same material as the ground plane 116, and may be connected to the ground plane 116 below the antenna layer 111 and the dielectric layer 112. The ground plane 116 and the front ground plane extension 113 may be formed from the same piece of material, or may be separate pieces of material joined together. The front ground plane extension 113 may assist in the operation of the multi-band antenna with a battery resonator 110 at lower frequencies.

The ground plane 116 may include the rear ground plane extension 121. The rear ground plane extension 121 may be made of the same material as the ground plane 116, and may be connected to the ground plane opposite the front ground plane extension 113. For example, if the ground plane 116 is circular, the front ground plane extension 113 and rear ground plane extension 121 may be arranged diametrically opposite each other. The ground plane 116 and the rear ground plane extension 121 may be formed from the same piece of material, or may be separate pieces of material joined together. The rear ground plane extension 121 may assist in the operation of the multi-band antenna with a battery resonator 110 at lower frequencies.

The dielectric layer 112 may be attached to the front ground plane extension 113 using any suitable manner of attachment. This may place the dielectric layer 112 in between the antenna layer 111 and the front ground plane extension 113. The antenna layer 111 may be aligned with the front ground plane extension 113 so that the transmission line 118 runs down the length of the front ground plane extension 113, perpendicular to the ground plane 116. The front ground plane extension may include a cutout 120. The transmission line 118 may be connected to a power source of the device 100, such as the battery 122, through the cutout 120, at the feed point 119. For example, a trace may pass through the cutout 120 to electrically connect the transmission line 118 to the battery 122 on the interior of the device 100.

The battery 122 may be any suitable battery for powering components of the device 100, including, for example, powering the multi-band antenna with a battery resonator 110. The battery 122 may include a metallic casing, and may be installed within the device 100. The battery 122 may be connected to battery terminals, which may have no good RF ground. The battery 122 may be proximity coupled to the front ground plane extension 113 and the rear ground plane extension 121, forming, along with the ground plane 116, the battery resonator. The battery resonator may be proximity coupled to the transmission line 118 of the antenna layer, and may resonate on lower frequencies similar to the frequencies at which the low-frequency antenna element 114 resonates.

Figure 2:
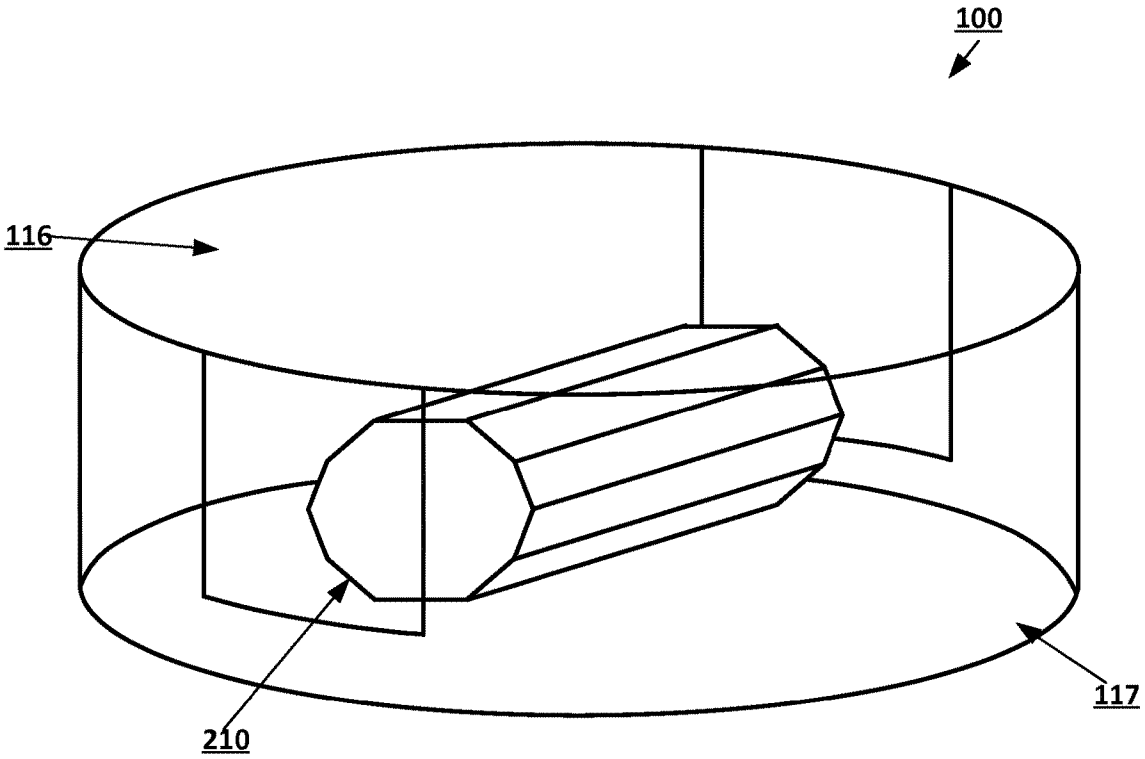
FIG. 2 shows an example perspective view of a multi-band antenna with a battery resonator according to an implementation of the disclosed subject matter.

FIG. 2 shows an example perspective view of a multi-band antenna with a battery resonator according to an implementation of the disclosed subject matter. The ground plane 116 may include the front ground plane extension 113 and the rear ground plane extension 121. The front ground plane extension 113 and the rear ground plane extension 121 may be made of the same material as the ground plane 116. The ground plane 116 and the front ground plane extension 113 and the rear ground plane extension 121 may be formed from the same piece of material, or may be separate pieces of material joined together. The front ground plane extension 113 and the rear ground plane extension 116 may be attached perpendicular to the ground plane 116, and opposite each other across the ground plane 116. The rear ground plane extension 121 may be larger than the front ground plane extension 121.

The battery 122 may be installed in the device 100 in between the front ground plane extension 113 and the rear ground plane extension 121. The battery 122 may be close enough to both the front ground plane extension 113 and the rear ground plane extension 121 to be proximity coupled to the front ground plane extension 113, the rear ground plane extension 121, and the ground plane 116, but may not touch any of the of the front ground plane extension 113, the rear ground plane extension 121, and the ground plane 116. The battery 122, the front ground plane extension 113, the rear ground plane extension 121, and the ground plane 116 may act as the battery resonator for the multi-band antenna with a battery resonator 110.

Figure 3A:
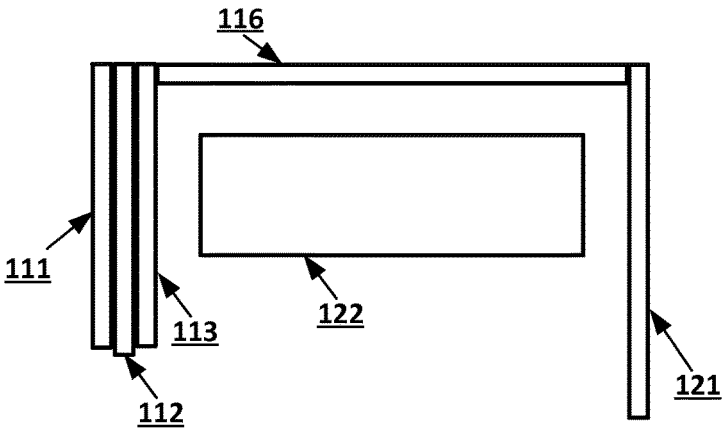
FIG. 3A shows an example side view of a multi-band antenna with a battery resonator according to an implementation of the disclosed subject matter.

FIG. 3A shows an example side view of a multi-band antenna with a battery resonator according to an implementation of the disclosed subject matter. The dielectric layer 112 may be in between the antenna layer 111 and the front ground plane extension 113. The ground plane 116 may be oriented perpendicular to the antenna layer 111, the dielectric layer 112, and the front ground plane extension 113. The rear ground plane extension 121 may be at an opposite end of the ground plane 116 from and parallel to the front ground plane extension 113, and may be perpendicular to the ground plane 116. The battery 122 may be in between the front ground plane extension 113 and the rear ground plane extension 121.

Figure 3B:
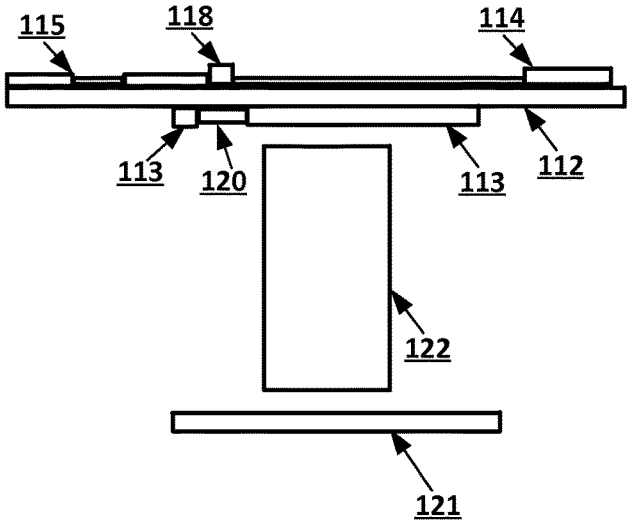
FIG. 3B shows an example top-down view of a multi-band antenna with a battery resonator according to an implementation of the disclosed subject matter.

FIG. 3B shows an example top-down view of a multi-band antenna with a battery resonator according to an implementation of the disclosed subject matter. The low-frequency antenna element 114, the high-frequency antenna element 115, and the transmission line 118, of the antenna element 111 may be arranged against and attached to the dielectric layer 112. The dielectric layer 112 may separate the components of the antenna layer 111 from the front ground plane extension 113. The front ground plane extension 113 may include the cutout 120, through which the transmission line 118 may be connected to a power source of the device 100. The power source may be, for example, the battery 122, which may be in between the front ground plane extension 113 and the rear ground plane extension 121.

Figure 4B:
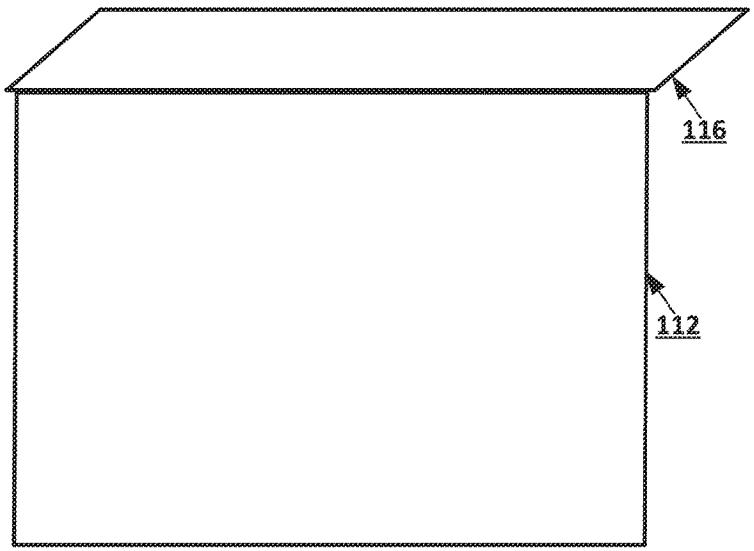
FIG. 4B shows an example dielectric layer view of a multi-band antenna with a battery resonator according to an implementation of the disclosed subject matter.
Figure 4A:
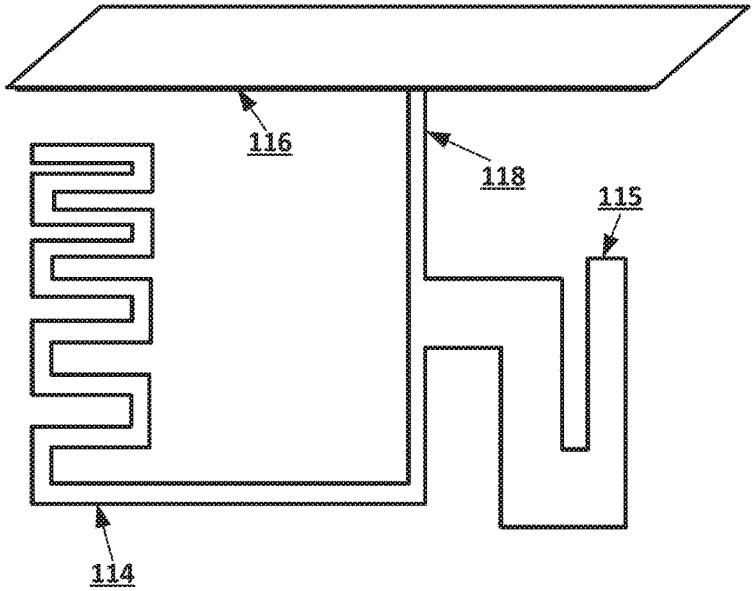
FIG. 4A shows an example antenna layer view of a multi-band antenna with a battery resonator according to an implementation of the disclosed subject matter.

FIG. 4A shows an example antenna layer view of a multi-band antenna with a battery resonator according to an implementation of the disclosed subject matter. The antenna layer 111 may include the low-frequency antenna element 114, the high-frequency antenna element 115, and the transmission line 118. The transmission line 118 may or not touch the ground plane 116, and may extend down from the ground plane 116. The high-frequency antenna element 115 may be any suitable shape, and may connect to the transmission line 118 near the middle of the length of the transmission line 118. The low-frequency antenna element 114 may be any suitable shape, and may connect to the transmission line 118 near the bottom of the length of the transmission line 118.

FIG. 4B shows an example dielectric layer view of a multi-band antenna with a battery resonator according to an implementation of the disclosed subject matter. The dielectric layer 112 may be any suitable size and made of any suitable dielectric material. The dielectric layer 112 may extend down from the ground plane 116, and may extend underneath the surface area of the antenna layer 111.

Figure 4D:
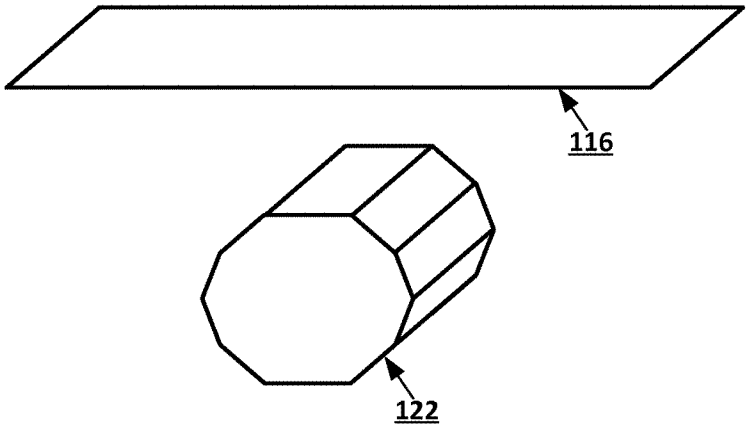
FIG. 4D shows an example battery view of a multi-band antenna with a battery resonator according to an implementation of the disclosed subject matter.
Figure 4C:
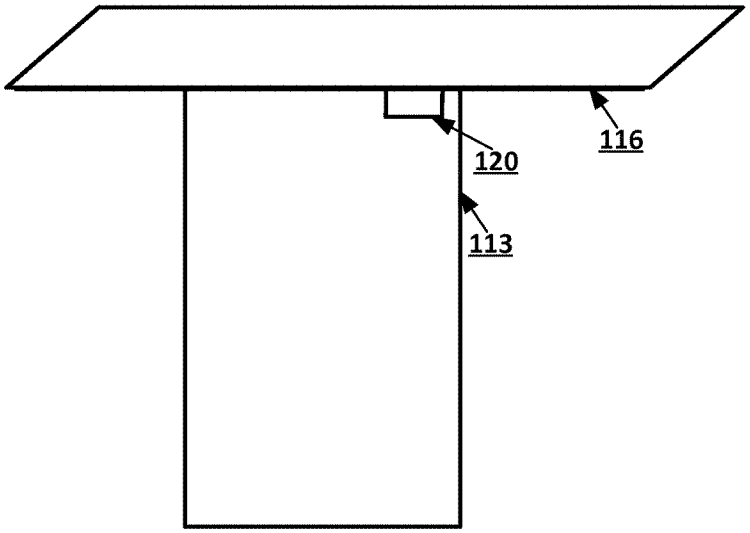
FIG. 4C shows an example front ground plane extension view of a multi-band antenna with a battery resonator according to an implementation of the disclosed subject matter.

FIG. 4C shows an example front ground plane extension view of a multi-band antenna with a battery resonator according to an implementation of the disclosed subject matter. The front ground plane extension 113 may be connected to the ground plane 116, and may extend down from the ground plane 116. The cutout 120 may be located at the top of the front ground plane extension 113, below the connection with the ground plane 116. The front ground plane extension 113 may have a greater length than the transmission line 118, but may be less wide than the dielectric layer 112.

FIG. 4D shows an example battery view of a multi-band antenna with a battery resonator according to an implementation of the disclosed subject matter. The battery 122 may be any suitable battery for powering components of the device 100. The battery 122 may be installed behind the front ground plane extension 113, in front of the rear ground plane extension 121, and below the ground plane 116. The battery 122 may not be in physical contact with the front ground plane extension 113, the rear ground plane extension 121, and the ground plane 116.

Figure 4F:
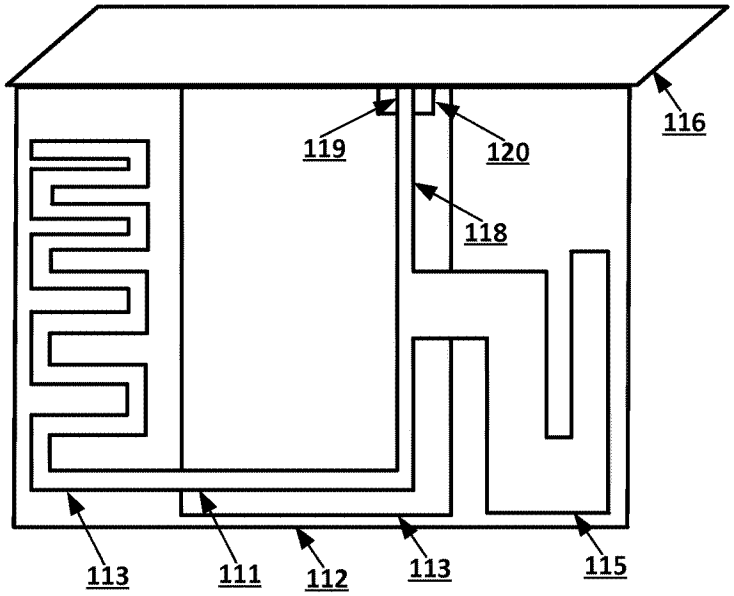
FIG. 4F shows an example view of a multi-band antenna with a battery resonator according to an implementation of the disclosed subject matter.
Figure 4E:
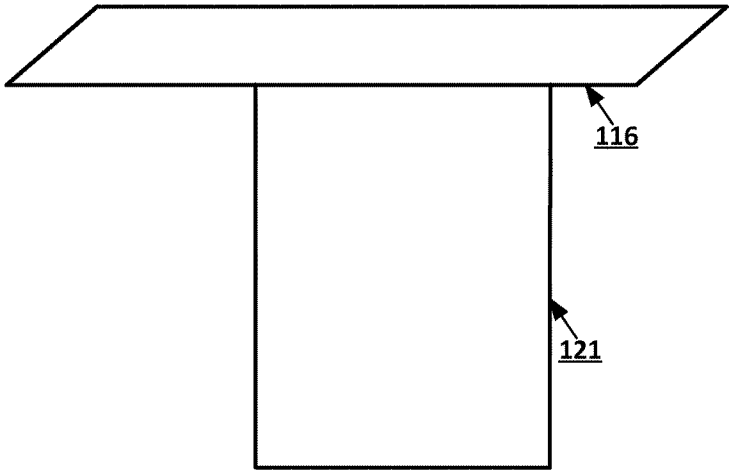
FIG. 4E shows an example rear ground plane extension view of a multi-band antenna with a battery resonator according to an implementation of the disclosed subject matter.

FIG. 4E shows an example rear ground plane extension view of a multi-band antenna with a battery resonator according to an implementation of the disclosed subject matter. The rear ground plane extension 121 may be connected to the ground plane 116, and may extend down from the ground plane 116. The rear ground plane extension 121 may be longer than the front ground plane extension 113. The rear ground plane extension 121 may be located opposite the front ground plane extension 113 across the ground plane 116.

FIG. 4F shows an example view of a multi-band antenna with a battery resonator according to an implementation of the disclosed subject matter. The antenna layer 111 may be attached to the dielectric layer 112. The dielectric layer 112 may cover the front ground plane extension 113. The dielectric layer 112 may be attached to the front ground plane extension 113, or to parts of the device 100 surrounding the front ground plane extension 113, such that the dielectric layer 112 sits in between the antenna layer 111 and the front ground plane extension 113. The transmission line 118 may extend down the front ground plane extension 113 from the ground plane 116, passing over the cutout 120, where the transmission line 118 may be connected to a power source at the feed point 119.

Figure 4G:
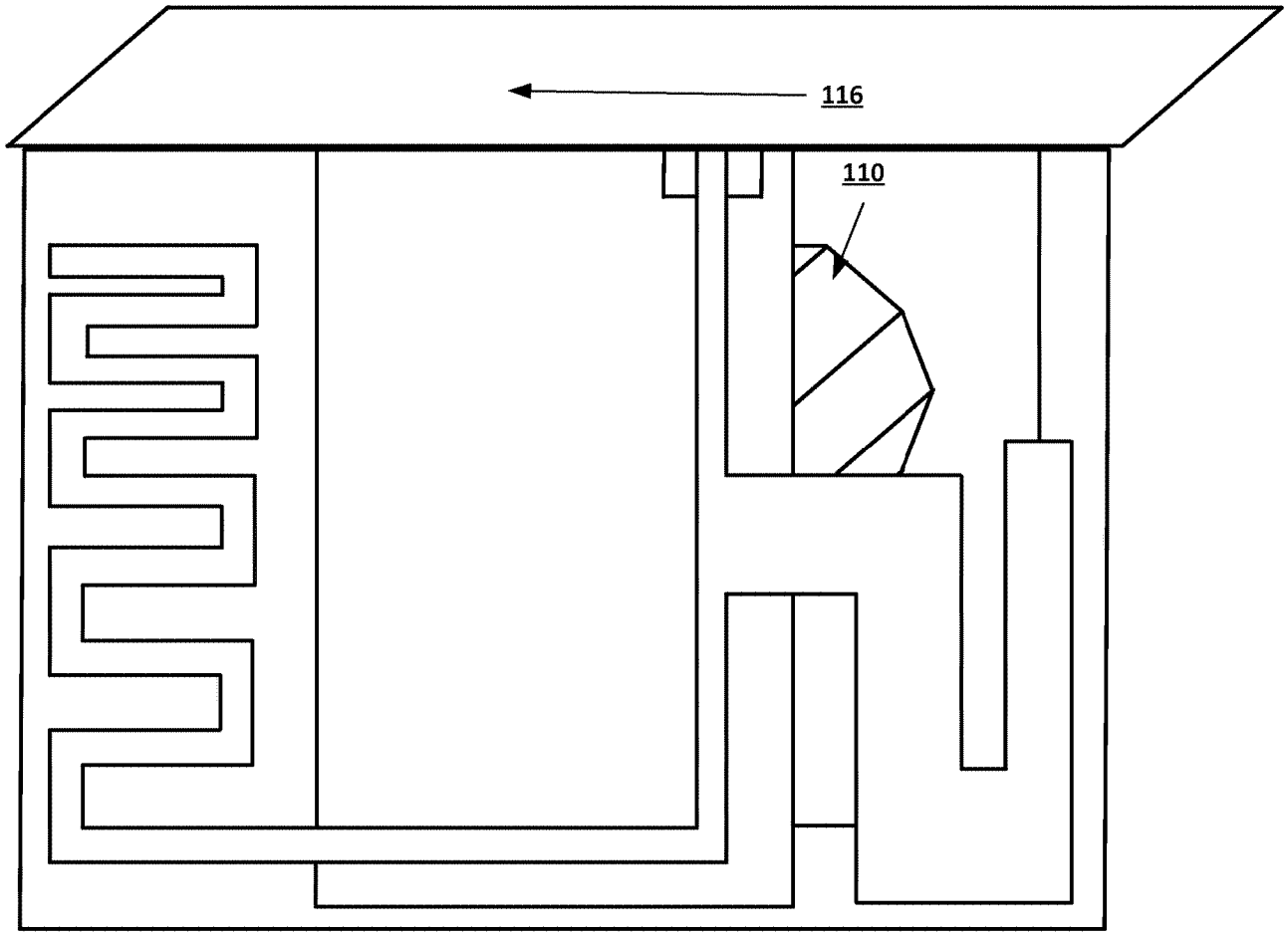
FIG. 4G shows an example view of a multi-band antenna with a battery resonator according to an implementation of the disclosed subject matter.

FIG. 4G shows an example view of a multi-band antenna with a battery resonator according to an implementation of the disclosed subject matter. The battery 122 may be in between the front ground plane extension 113 and the rear ground plane extension 121, and may be proximity coupled to the front ground plane extension 113, the rear ground plan extension 121, and the ground plane 116 to form the battery resonator. The battery resonator may be proximity coupled through the dielectric layer 112 to the transmission line 118 and low-frequency antenna element 114 of the antenna layer 111.

Figure 5:
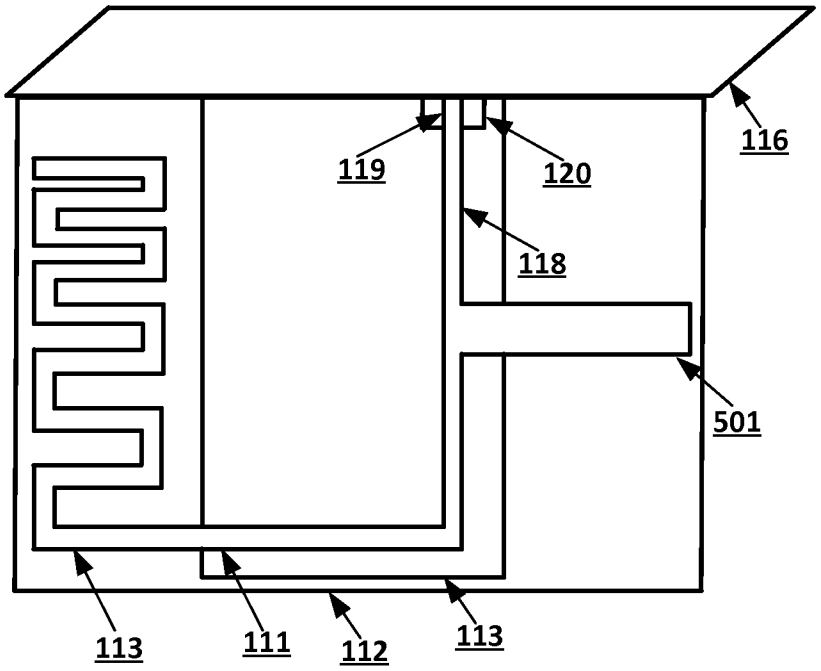
FIG. 5 shows an example view of a multi-band antenna with a battery resonator according to an implementation of the disclosed subject matter.

FIG. 5 shows an example view of a multi-band antenna with a battery resonator according to an implementation of the disclosed subject matter. The high-frequency antenna element of the antenna layer 111 may be in any suitable shape. For example, in some implementations the high-frequency antenna element may be a straight arm antenna 501.

Figure 6:
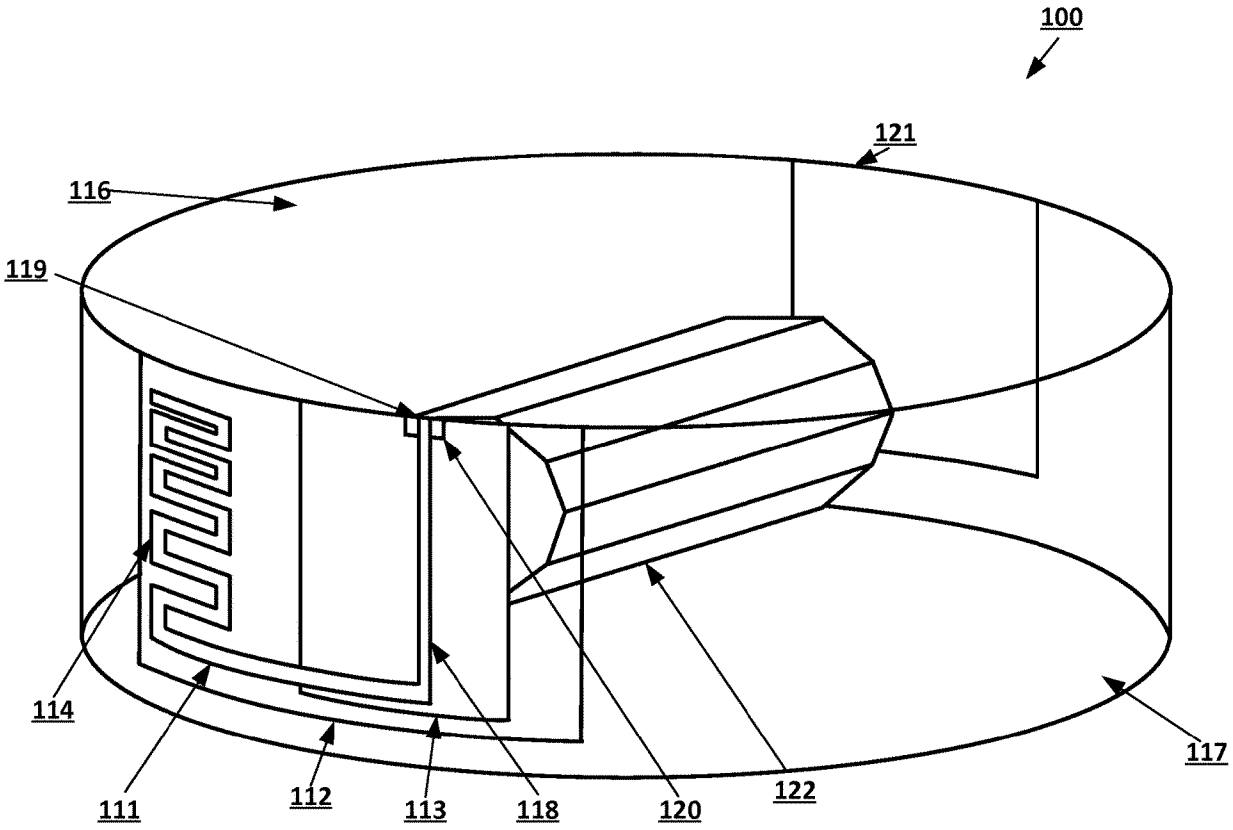
FIG. 6 shows an example perspective view of a single-band antenna with a battery resonator.

FIG. 6 shows an example perspective view of a single-band antenna with a battery resonator. In some implementations the battery resonator may be used with a single-band antenna. For example, the antenna layer 111 may include the transmission line 118 and the low-frequency antenna element 114, which may be, for example, a meander antenna, and may not include the high-frequency antenna element 115. The single-band antenna may operate on lower frequencies, with the low-frequency antenna element 114 and the battery resonator, including the front ground plane extension 113, the rear ground plane extension 121, the ground plane 116, and the battery 122, acting as a low-frequency resonator.

Figure 7:
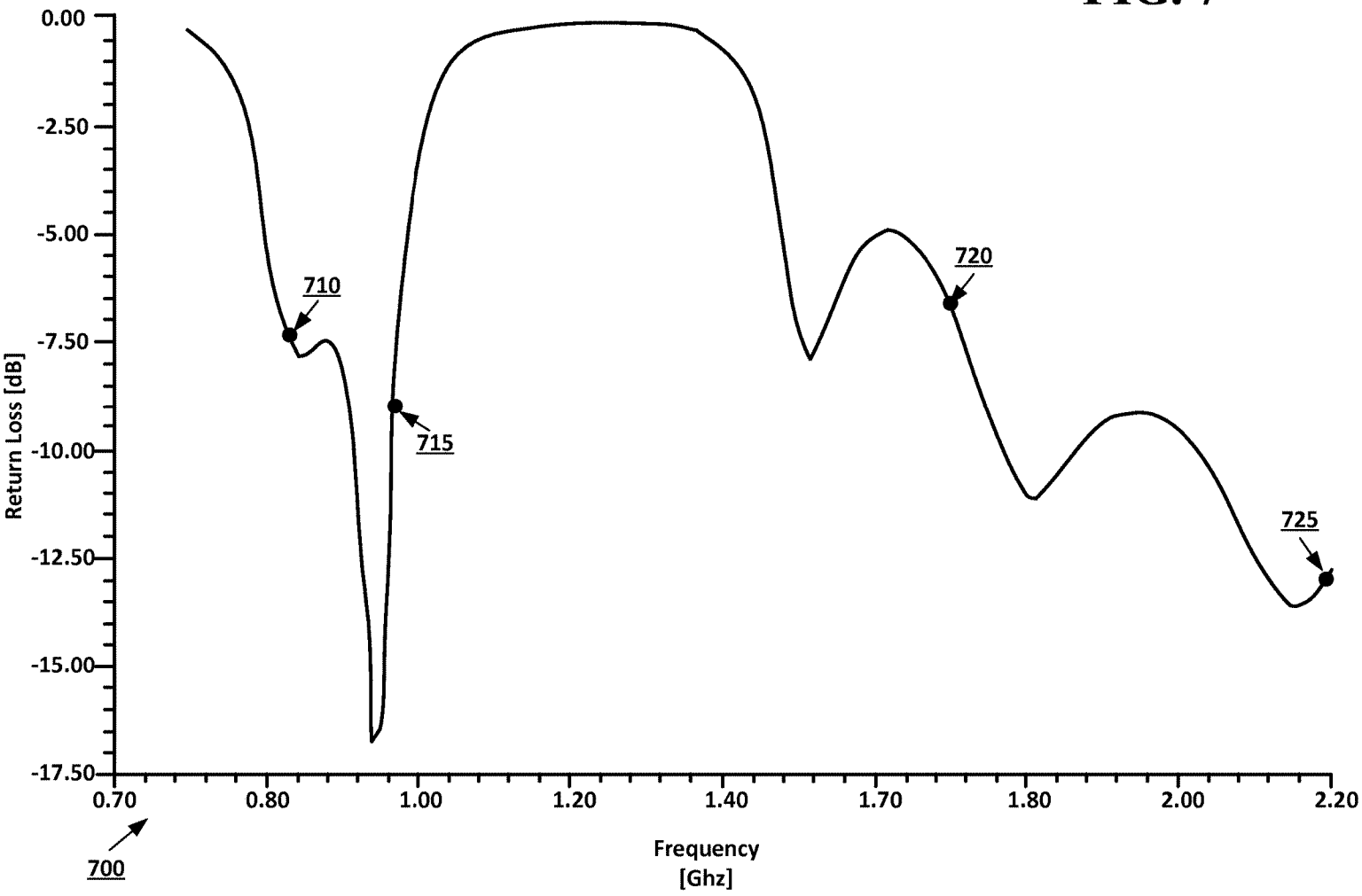
FIG. 7 shows an example of a return loss graph for a multi-band antenna with a battery resonator according to an implementation of the disclosed subject matter.

FIG. 7 shows an example of a return loss graph for a multi-band antenna with a battery resonator according to an implementation of the disclosed subject matter. The return loss graph 700 may plot the return loss of the multi-band antenna with a battery resonator 110 in decibels against the frequencies, in GHz, at which the multi-band antenna with a battery resonator 110 may operate. The low-frequency antenna element 114 and battery resonator may be made to operate best between the frequencies of 824 and 960 MHz, as shown by the plot of the return loss graph 700 between point 710, at 824 MHz, and point 715, at 960 MHz. The high-frequency antenna element 115 of the multi-band antenna a battery resonator 110 may be made to operate best between the frequencies of 1700 MHz and 2200 MHz, as shown by the plot of the return loss graph 700 between point 720, at 1700 MHz, and point 725, at 2200 MHz. The return loss of the multi-band antenna with a battery resonator 110 may be very low over these ranges of frequencies, as compared to the return loss at frequencies outside of these ranges. The battery resonator may widen the low-frequency band on which the multi-band antenna with a battery resonator 110 may operate.

Figure 8:
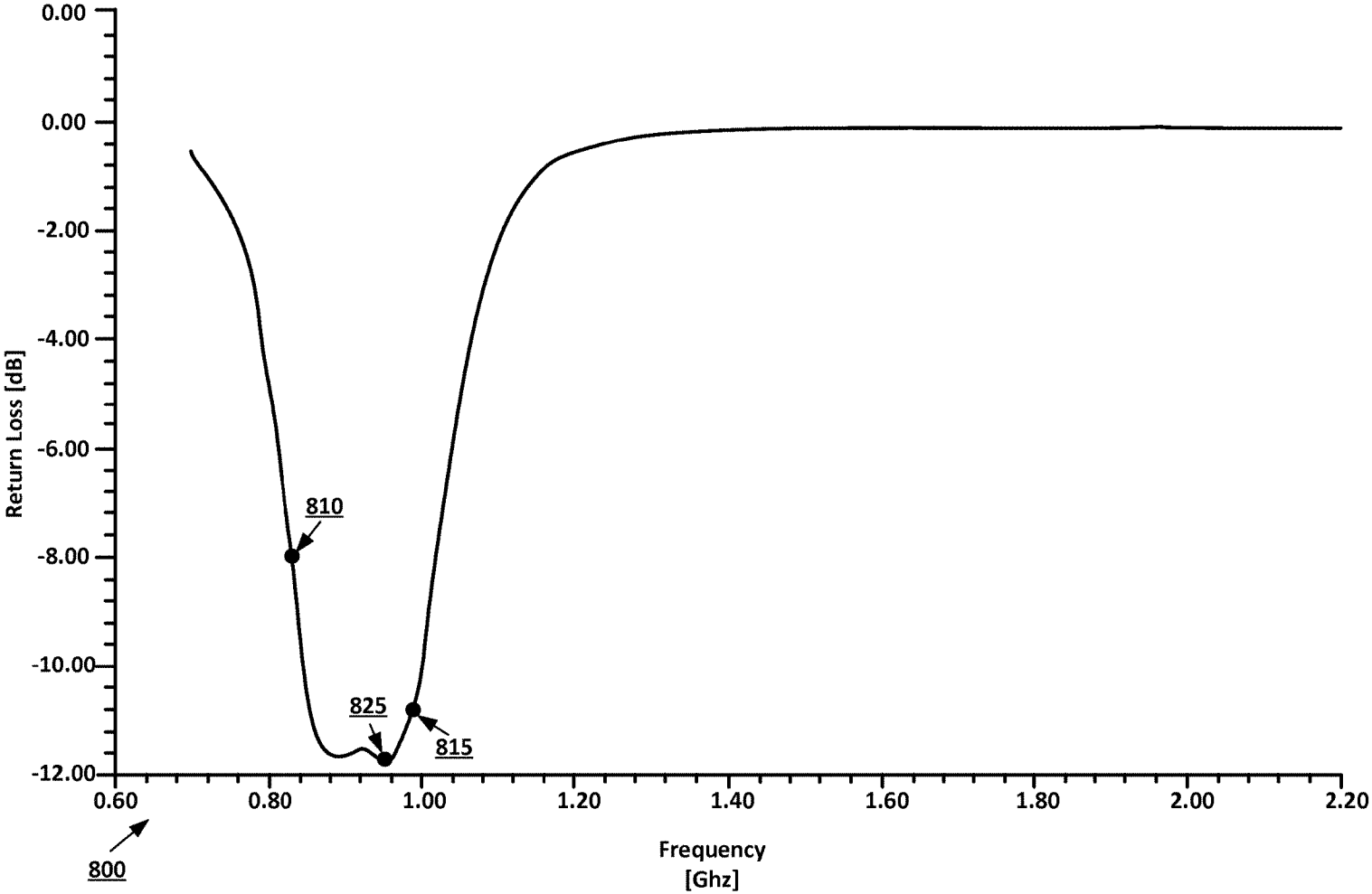
FIG. 8 shows an example of a return loss graph for a single-band antenna with a battery resonator according to an implementation of the disclosed subject matter.

FIG. 8 shows an example of a return loss graph for a single-band antenna with a battery resonator according to an implementation of the disclosed subject matter. The return loss graph 800 may plot the return loss of a single-band antenna with a battery resonator in decibels against the frequencies, in GHz, at which the single-band antenna with a battery resonator may operate. The low-frequency antenna element 114 and battery resonator may be made to operate best between the frequencies of 824 and 960 MHz, as shown by the plot of the return loss graph 800 between point 810, at 824 MHz, and point 815, at 960 MHz. The return loss of the single-band antenna with a battery resonator may be very low over this range of frequencies, as compared to the return loss at frequencies outside of these ranges. The valley in the return loss graph 800 at point 820 may be caused by the use of the battery resonator. The battery resonator may widen the low-frequency band on which the single-band antenna with a battery resonator may operate.

Figure 9:
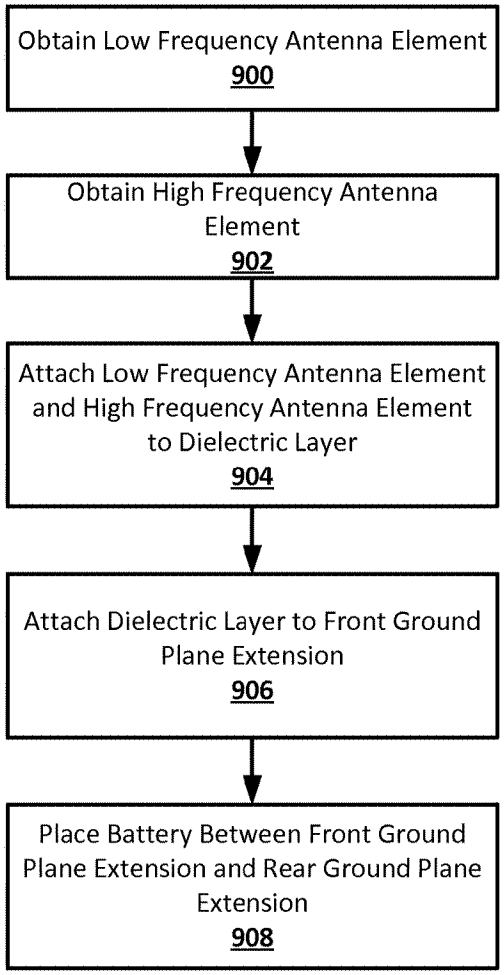
FIG. 9 shows an example of a process for assembling a multi-band antenna with a battery resonator according to an implementation of the disclosed subject matter.

FIG. 9 shows an example of a process for assembling a multi-band antenna with a battery resonator according to an implementation of the disclosed subject matter. At 900, a low-frequency antenna element may be obtained. For example, the low-frequency resonator 114, which may be a meander antenna suitable for use at low-frequencies, may be obtained.

At 902, a high-frequency antenna element may be obtained. For example, high-frequency element 115 may be obtained. For example, the high-frequency antenna element 115, which may be a straight arm antenna or a meander antenna suitable for use at high frequencies, may be obtained. The high-frequency antenna element 115 and the low-frequency antenna element 114 may be attached to the transmission line 118, all of which may be formed from the same piece of material, such as, for example, PCB flex material.

At 904, the low-frequency antenna element and the high frequency antenna element may be attached to a dielectric layer. For example, the low-frequency antenna element 114 and the high-frequency antenna element 115, along with the transmission line 118, forming the antenna layer 111, may be attached to the dielectric layer 112, which may be any suitable dielectric material, in any suitable manner. The dielectric layer 112 may extend underneath the surface area of the antenna layer 111.

At 906, the dielectric layer may be attached to a front ground plane extension. For example, the dielectric layer 112, with attached antenna layer 111, may be attached directly to, or attached such that it covers, the front ground plane extension 113. The dielectric layer 112 may be in between the antenna layer 111 and the front ground plane extension 113. The transmission line 118 of the antenna layer 111 may run across or into the cutout 120 in the front ground plane extension 113, allowing the antenna layer 111 to be connected to a power source at the feed point 119.

At 908, a battery may be placed between the front ground plane extension and the rear ground plane extension. For example, the battery 122 may be placed between the front ground plane extension 113 and the rear ground plane extension 121, below the ground plane 116, forming a battery resonator based on proximity coupling. The battery 122 may not touch any of the front ground plane extension 113, the rear ground plane extension 121, and the ground plane 116. The battery resonator may be proximity coupled to the low-frequency antenna element 114, and may act as a low-frequency resonator along with the low-frequency antenna element 114.

The low-frequency antenna element 114, for example, as obtained in 700, may selected and positioned on the antenna layer 111 based on the resonance of the battery resonator. Different shapes and sizes of the battery 122 may require different shapes or positioning of the low-frequency antenna element 114 to allow the battery resonator and the low-frequency antenna element 114 to act as a low-frequency resonator.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

Figure 10:
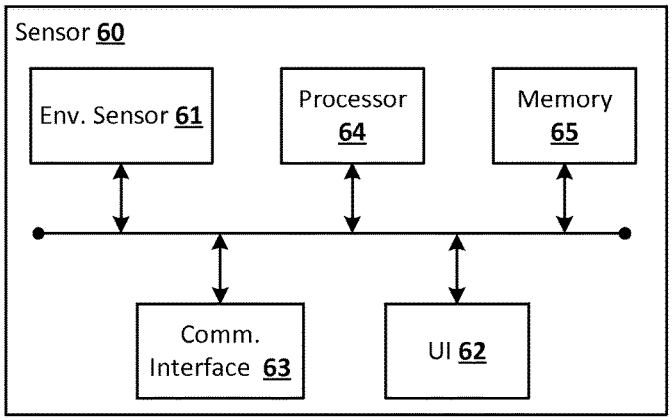
FIG. 10 shows a computing device according to an embodiment of the disclosed subject matter.

A sensor may include hardware in addition to the specific physical sensor that obtains information about the environment. FIG. 10 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like, may allow for communication by the sensor 60 with other devices. The communication interface 63 may include or be in signal contact with a modified Vivaldi antenna as disclosed herein, for example to allow for communication on multiple separate frequencies. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 11:
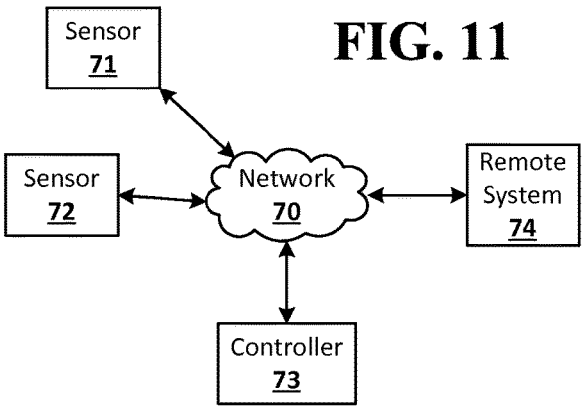
FIG. 11 shows a system according to an embodiment of the disclosed subject matter.

FIG. 11 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72. As previously described, a sensor or any other component within a sensor network may include or use a modified Vivaldi antenna when communicating with one or more other devices in the sensor network.

The sensor network shown in FIG. 11 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 11 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 11.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 11, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 11, and the controller 73 may control an alarm system to provide a visual and/or audible alarm to the user of the smart-home environment.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 11 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 shown in FIG. 11. The smart wall switches may detect ambient lighting conditions, and control a power and/or dim state of one or more lights. For example, the sensors 71, 72, may detect the ambient lighting conditions, and the controller 73 may control the power to one or more lights (not shown) in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, the smart-home environment may include one or more intelligent, multi-sensing, network-connected entry detectors (e.g., "smart entry detectors"). The sensors 71, 72 shown in FIG. 11 may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 11 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 of FIG. 11 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

Figure 12:
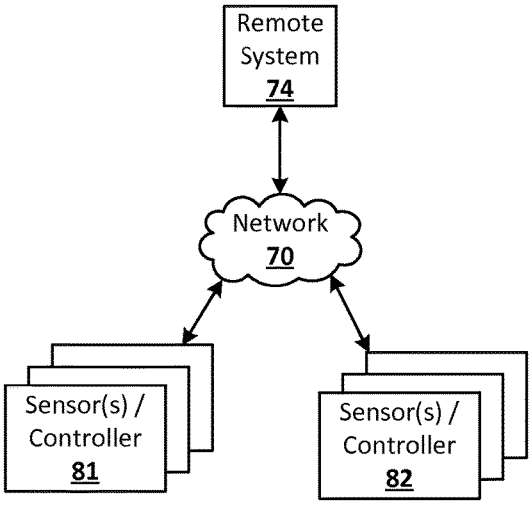
FIG. 12 shows a system according to an embodiment of the disclosed subject matter.

In some configurations, a remote system 74 may aggregate data from multiple locations, such as multiple buildings, multi-resident buildings, individual residences within a neighborhood, multiple neighborhoods, and the like. FIG. 12 shows a system according to an embodiment of the disclosed subject matter. In general, multiple sensor/controller systems 81, 82 as previously described with respect to FIG. 11 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Figure 13:
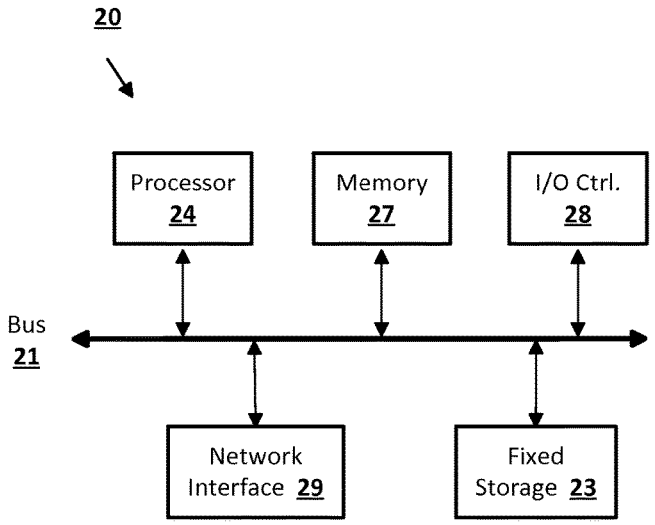
FIG. 13 shows a computer according to an embodiment of the disclosed subject matter.

Embodiments of the presently disclosed subject matter may be implemented in and used with a variety of computing devices. FIG. 13 is an example computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone, WiFi, Bluetooth®, near-field, and the like. For example, the network interface 29 may allow the device to communicate with other computers via one or more local, wide-area, or other communication networks, as described in further detail herein.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. An antenna apparatus comprising:
- a ground plane;
- a front ground plane extension attached to the ground plane;
- a rear ground plane extension attached to the ground plane;
- a dielectric layer comprising a dielectric material disposed over the front ground plane extension;
- an antenna layer disposed over the dielectric layer such that the dielectric layer is in between the antenna layer and the front ground plane extension, the antenna layer comprising:
  - a high frequency antenna element,
  - a low frequency antenna element, and
  - a transmission line, the high frequency antenna element having an end attached to the transmission line and the low-frequency antenna element having an end attached to the transmission line; and
- a battery disposed in between the front ground plane extension and the rear ground plane extension such that the battery is proximity coupled to the front ground plane extension and the rear ground plane extension, and wherein the front ground plane extension, rear ground plane extension, ground plane and battery are proximity coupled to the low-frequency antenna element.

2. The apparatus of claim 1, wherein the front ground plane extension and the rear ground plane extension are disposed perpendicular to the ground plane.

3. The apparatus of claim 1, wherein the front ground plane extension further comprises a cutout.

4. The apparatus of claim 3, wherein the transmission line is connected to a power source through the cutout.

5. The apparatus of claim 4, wherein the power source is the battery.

6. The apparatus of claim 1, wherein the antenna layer comprises copper.

7. The apparatus of claim 1, wherein the ground plane is circular, and wherein the front ground plane extension and the rear ground plane extension are disposed diametrically opposite each other across the ground plane.

8. The apparatus of claim 1, wherein the battery is disposed between and in contact with battery terminals, wherein the battery terminals have no RF ground.

9. The apparatus of claim 1, wherein the battery is disposed within a metalized compartment.

10. The apparatus of claim 1, wherein a battery resonator comprises the ground plane, the front ground plane extension, the rear ground plane extension, and the battery.

11. The apparatus of claim 10, wherein the battery resonator is a radiator for low-frequency operation of the antenna apparatus.

12. The apparatus of claim 10, wherein the low-frequency antenna element is disposed relative to the battery resonator such that the low-frequency antenna element and the battery resonator resonate on continuous low-frequency band.

13. The apparatus of claim 1, wherein the ground plane is a printed circuit board.

14. An antenna apparatus comprising:
- an antenna layer comprising a low-frequency antenna element and a transmission line;
- a dielectric layer;
- a wall; and
- a battery resonator comprising a front ground plane extension, a rear ground plane extension, and a battery, wherein the front ground plane extension is disposed on an outside portion of the wall, the rear ground plane extension is disposed on another outside portion of the wall, and the battery is disposed within the wall oriented between the front ground plane extension and the rear ground plane extension such that the battery is proximity coupled to the front ground plane extension and the rear ground plane extension, and wherein the battery resonator is proximity coupled to the low-frequency antenna element.

15. The apparatus of claim 14, wherein the front ground plane extension and rear ground plane extension are disposed opposite each other.

16. The apparatus of claim 14, low-frequency antenna element and the antenna layer are positioned relative to the battery resonator such that the low-frequency antenna element and the battery resonator resonate on continuous low-frequency band.

17. The apparatus of claim 14, wherein the low-frequency antenna element is a meander antenna.

18. The apparatus of claim 14, wherein the antenna layer further comprises a high-frequency antenna element.

19. The apparatus of claim 14, wherein the battery resonator is a radiator for low frequency operation of the antenna apparatus.

20. The apparatus of claim 18, wherein antenna apparatus operates on a first frequency band with the battery resonator and low-frequency antenna element, and operates on a second frequency band high-frequency antenna element, the first frequency band being lower than the second frequency band.

21. A method comprising:
- obtaining a low-frequency antenna element;
- obtaining a high-frequency antenna element;
- attaching the low-frequency antenna element and the high-frequency antenna element to a dielectric layer;
- attaching the dielectric layer to a front ground plane extension; and placing a battery between the front ground plane extension and the rear ground plane extension.

* * * * *